United States Patent [19]

Jarosz et al.

[11] Patent Number: 4,934,974

[45] **Date of Patent: * Jun. 19, 1990**

[54] FACTORY FIXTURE FRAME WITH MEANS FOR TEMPORARILY AND REMOVABLY SUPPORTING AN IN-PROCESS TENSION MASK FOR A COLOR CATHODE RAY TUBE

[75] Inventors: John M. Jarosz, Skokie; Paul Strauss, Chicago, both of Ill.

[73] Assignee: Zenith Electronics Corporation, Glenview, Ill.

[ * ] Notice: The portion of the term of this patent subsequent to Dec. 13, 2005 has been disclaimed.

[21] Appl. No.: 140,019

[22] Filed: Dec. 31, 1987

[51] Int. Cl.[5] ..... H01J 9/227; H01J 9/00

[52] U.S. Cl. ..... 445/30; 445/68; 24/462; 29/448; 38/102.91

[58] Field of Search ..... 445/30, 37, 68; 313/407; 269/254 R, 254 D; 29/447, 448; 24/462; 38/102.91; 160/371; 140/109

[56] References Cited

U.S. PATENT DOCUMENTS

| | | | |
|---|---|---|---|
| 2,625,734 | 1/1953 | Law | 445/52 |
| 2,654,940 | 10/1953 | Law | 445/36 |
| 2,867,028 | 1/1959 | Trost | 24/462 |
| 3,357,459 | 12/1967 | Cahen et al. | 140/109 X |
| 3,557,695 | 1/1971 | Preuss | 101/415.1 R |
| 3,894,321 | 7/1975 | Moore | 313/402 X |
| 3,962,805 | 6/1976 | Hamu | 160/371 X |
| 4,525,909 | 7/1985 | Newman | 38/102.91 X |
| 4,547,696 | 10/1985 | Strauss | 313/407 |
| 4,591,344 | 5/1986 | Palac | 445/30 |
| 4,593,224 | 6/1986 | Palac | 313/402 |
| 4,656,389 | 4/1987 | Palac | 313/407 X |
| 4,790,786 | 12/1988 | Stauss | 269/40 X |

FOREIGN PATENT DOCUMENTS

| | | | |
|---|---|---|---|
| 121628 | 10/1984 | European Pat. Off. | 445/30 |

OTHER PUBLICATIONS

Improvements in the RCA Three-Beam Shadow Mask Color Kinescope, by Grimes, et al. The IRE, Jan., 1954; decimal classification R583.6.

*Primary Examiner*—Kenneth J. Ramsey

[57] ABSTRACT

A reusable factory fixture frame is disclosed for use in the manufacture of a color cathode ray tube having a flat faceplate and a tensed foil shadow mask. The frame provides for mounting an in-process shadow mask during photoexposure of an in-process faceplate in a lighthouse. The frame includes a generally rectangular frame structure having grooves thereabout for receiving an edge of the shadow mask. Quick-release mechanical spring clips are provided for temporarily and removably supporting the in-process shadow mask in tension in the grooves. The shadow mask is heated and allowed to expand prior to being temporarily and removably supported on the frame, and the shadow mask is allowed to cool and shrink in tension while so being supported to effect tensing of the shadow mask in clamped condition on the frame.

34 Claims, 8 Drawing Sheets

FACTORY FIXTURE FRAME WITH MEANS FOR TEMPORARILY AND REMOVABLY SUPPORTING AN IN-PROCESS TENSION MASK FOR A COLOR CATHODE RAY TUBE

CROSS REFERENCE TO RELATED APPLICATIONS AND PATENTS

This application is related to but in no way dependent upon copending applications Ser. Nos. 583,003, filed Sept. 30, 1983, now abandoned; Ser. No. 646,861, now U.S. Pat. No. 4,614,892, issued Sept. 30, 1986; Ser. No. 758,174, now U.S. Pat. No. 4,713,034, issued Dec. 15, 1987; Ser. No. 831,696, now U.S. Pat. No. 4,721,488, issued Jan. 26, 1988; Ser. No. 894,984, now U.S. Pat. No. 4,739,412, issued Apr. 19, 1988; Ser. No. 947,727, now U.S. Pat. No. 4,739,215, issued Apr. 19, 1988 ; Ser. No. 051,896, now U.S. Pat. No. 4,790,786, issued Dec. 13, 1988; Ser. No. 058,095, now U.S. Pat. No. 4,828,523, issued May 9, 1989; Ser. No. 131,968, now U.S. Pat. No. 4,790,785, issued Dec. 13, 1988; and U.S. Pat. Nos. 3,894,321; 4,069,567; 4,547,696; 4,591,344; 4,593,224; and 4,595,857, all of common ownership herewith.

BACKGROUND OF THE INVENTION

1. Field Of The Invention

This invention relates to color cathode ray picture tubes, and is addressed specifically to improved factory means and processes for the manufacture of a tube having a tensed foil shadow mask. Color tubes of various types that have a tension foil mask can be manufactured by the process, including those used in home entertainment television receivers. The invention is particularly valuable in the manufacture of medium-resolution, high-resolution, and ultra-high resolution tube intended for color monitors.

The use of a foil-type flat tensed mask and flat faceplate provides many benefits in comparison to the conventional domed shadow mask and correlatively curved faceplate. Chief among these is a greater power-handling capability which makes possible as much as a three-fold increase in brightness. The conventional curved shadow mask, which is not under tension, tends to "dome" in picture areas of high brightness where the intensity of the electron beam bombardment is greatest. Color impurities result as the mask moves closer to the faceplate and as the beam-passing apertures move out of registration with their associated phosphor elements on the faceplate. The tensed mask when heated distorts in a manner quite different from the conventional mask. If the entire mask is heated uniformly, there is no doming and no distortion until tension is completely lost; just before that point, wrinkling may occur in the corners. If only portions of the mask are heated, those portions expand, and the unheated portions contract, resulting in displacements within the plane of the mask; i.e., the mask remains flat.

The tensed foil shadow mask is part of the cathode ray tube front assembly, and is located in close adjacency to the faceplate. The front assembly comprises the faceplate with its screen which consists of deposits of light-emitting phosphors, a shadow mask, and support means for the mask. As used herein, the term "shadow mask" means an apertured metallic foil which may, by way of example, be about 0.001 inch or less in thickness. The mask must be supported under high tension a predetermined distance from the inner surface of the cathode ray tube faceplate. This distance is known as the "Q-distance". As is well known in the art, the shadow mask acts as a color-selection electrode, or parallax barrier, which ensures that each of the three electron beams lands only on its assigned phosphor deposits.

The conventional process of depositing patterns of color phosphor elements on the screening surface of a color picture tube faceplate utilizes the well-known photoscreening process. A shadow mask, which in effect functions as a perforated optical stencil, is used in conjunction with a light source to expose in successive steps, three discrete light-sensitive photoresist patterns on the screening surface. The shadow mask is typically "mated" to each faceplate; that is, the same mask is used in the production of a specific tube throughout the production process, and is permanently installed in the tube in final assembly. At least four engagements and four disengagements of the mask, as well as six exposures, are required in the standard screening process. In certain processes, a "Master" may be used for exposing the photoresist patterns in lieu of the mated shadow mask.

2. Prior Art

There have been a number of disclosures of tensed foil masks and means for applying tension to the mask and retaining the mask under tension. Typical of these is the disclosure of Law in U.S. Pat. No. 3,625,734 which addresses the construction of a taut, planar foraminous mask. A foil mask blank is loosely mounted in a two-section frame, and the mask is expanded by the hot-blocking process. Machine screws peripheral to the frame provide for clamping the mask tightly in the frame when the mask is in its expanded state. The mask becomes tensed upon cooling as it is restrained from returning to its former dimensions by its captivation by the frame. The frame with the mask enclosed is mounted with the phosphor-screen as a unitary assembly adjacent to the inner surface of the faceplate. Law in U.S. Pat. No. 2,654,940 also discloses means for stretching and captivating by frames masks formed from wire mesh.

U.S. Pat. No. 3,894,321 to Moore, of common ownership herewith, is directed to a method for processing a color cathode ray tube faceplate in conjunction with a thin foil tension shadow mask. A frame screw-clamp supports a tensed mask during lighthouse exposure of an associated screen. The faceplate is registered with the mask support frame by means of three alignment posts which extend from the lighthouse, and against which the frame and the faceplate are both biased by gravity. The faceplate and frame, being both referenced to the three lighthouse posts, are thereby referenced to each other.

U.S. Pat. No. 4,591,344 to Palac, of common ownership herewith, discloses a method of making a color cathode ray tube in which a frame on which a shadow mask is stretched has indexing means cooperable with registration-affording means on a faceplate. The assembly provides for multiple registered matings of the faceplate and mask during photoscreening operations. A photographic plate is used in a process for applying the phosphor elements to the faceplate screening surface to provide a interchangeable mask system. This in lieu of the more common method of using a shadow mask permanently mated with a faceplate, and which serves as an optical stencil during the photoscreening process. The sealing areas of the faceplate and the frame are joined in a final assembly operation such that the frame becomes an integral constituent of the cathode ray tube.

A mask registration and supporting system for a cathode ray tube having a rounded faceplate with a skirt for attachment to a funnel is disclosed by Strauss in U.S. Pat. No. 4,547,696 of common ownership herewith. The skirt of the faceplate provides the necessary Q-distance between the mask and the screen. A frame dimensioned to enclose the screen comprises first and second spaced-apart surfaces. A tensed foil shadow mask has a peripheral portion bonded to a second surface of the frame. The frame is registered with the faceplate by ball-and-groove indexing means. The shadow mask is sandwiched between the frame and a stabilizing or stiffening member. Following final assembly, the frame is permanently fixed in place within the tube envelope between the sealing lands of the faceplate and a funnel, with a stiffening member projecting from the frame into the funnel.

In U.S. Pat. No. 4,593,224 to Palac, of common ownership herewith, there is disclosed a shadow mask mount in the shape of a rectangular frame for use in tensing an in-process shadow mask, and for temporarily supporting the mask while in tension. An apertured foil comprising the in-process mask is laid across the opening in the frame and is secured to the frame by brazing or welding. The coefficient of thermal expansion of the foil is preferably equal to or slightly less than that of the frame. A glass frame is also provided that consists of two identical rectangular members smaller in circumferential dimension than the metal frame. When joined into a single frame, the members are located between the tube faceplate and funnel to become an integral part of the tube envelope in final assembly. Each member of the glass frame has indexing means, one member for indent-detent registration with the faceplate, and the other for indent-detent registration with the funnel. Following the application of a layer of devitrifying cement in paste form to the facing surfaces of the two members, the mask, held in the metal frame, is sandwiched between the two members. As the assembly is heated, the expansion of the mask is taken up by screw mean attached to the metal frame which press against the peripheries of the members. Upon cooling of the assembly, the coefficient of thermal expansion of the mask, being greater than that of the glass, results in the mask being held permanently in tension by the glass frame through the medium of the frit cement, which has become solidified by the heat. The portion of the mask that projects beyond the periphery of the glass frame is severed to release the metal frame. The glass frame with its captivated mask is then mounted on a lighthouse for photoscreening the faceplate, with registration with the lighthouse and faceplate provided by the indent-detent means described.

In referent copending application Ser. No. 831,696 of common ownership herewith, there is disclosed an apparatus for tensing a foil shadow mask. The apparatus comprises a pedestal having registration-affording means, and a tensing structure which includes a fixture comprising a pair of collars for clamping the edge of a foil to support and maintain the foil in a taut condition. An anvil is provided for engaging a peripheral portion of the clamped foil to induce deflection of the foil, and thereby, a predetermined tension in the foil. Following a photoscreening process, the mask is secured to shadow mask supports extending from the faceplate by welding.

In a journal article, there is described means for mounting a flat tensed mask on a frame for use in a color cathode ray tube having a circular faceplate with a curved viewing surface. In one embodiment, the mask, which is also circular, is described as being welded to a circular frame comprised of a ⅛-inch steel section. The frame with captivated mask is mounted in spaced relationship to a phosphordot plate, and the combination is assembled into the tube as a package located adjacent to the faceplate. ("Improvements in the RCA Three-Beam Shadow Mask Color Kinescope," by Grimes et al. The IRE, January 1954; decimal classification R583.6.).

OBJECTS OF THE INVENTION

It is a general object of this invention to provide means to facilitate the manufacture of color cathode ray tubes having a tensed foil shadow mask.

It is an object of this invention to provide improved fixturing means that will facilitate the manufacture of color cathode ray tubes having a tensed foil shadow mask.

It is another object of this invention to provide improved fixturing means for use in manufacturing an in-process assembly comprising a tensed foil in-process shadow mask and a faceplate.

It is a further object of this invention to provide a factory fixture frame including tensed foil in-process shadow mask clamping means for quickly and securely clamping and retaining a shadow mask under high tension without damage to the mask.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings (not to scale), in the several figures of which like reference numerals identify like elements, and in which:

DETAILED DESCRIPTION OF THE PREFERRED EMBODIMENT

To facilitate understanding of the factory fixture frame and its relation to the process of manufacturing a tensed mask cathode ray tube, copending application Ser. No. 051,896, filed May 18, 1987, is incorporated herein by reference. That application sets forth in detail the components of a factory fixture frame for an in-process tension mask color cathode ray tube and its relationship to the tube components.

Figure 5:
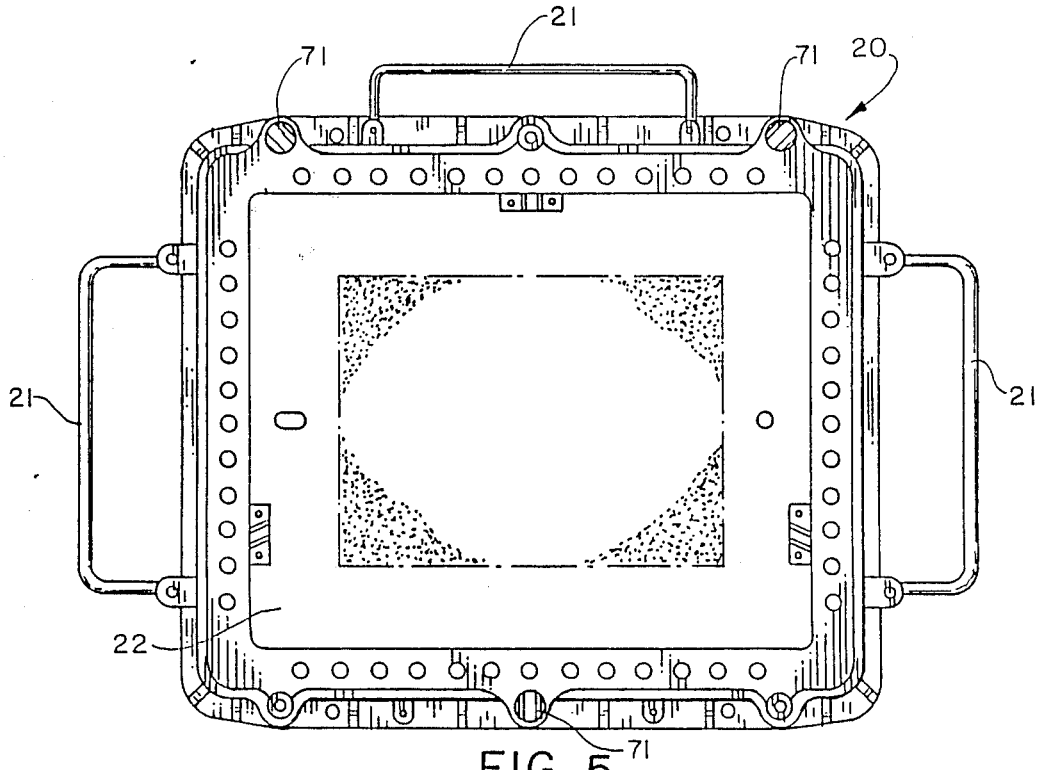
FIG. 5 is a plan view of the topside of a factory fixture frame according to the invention.
Figure 6:
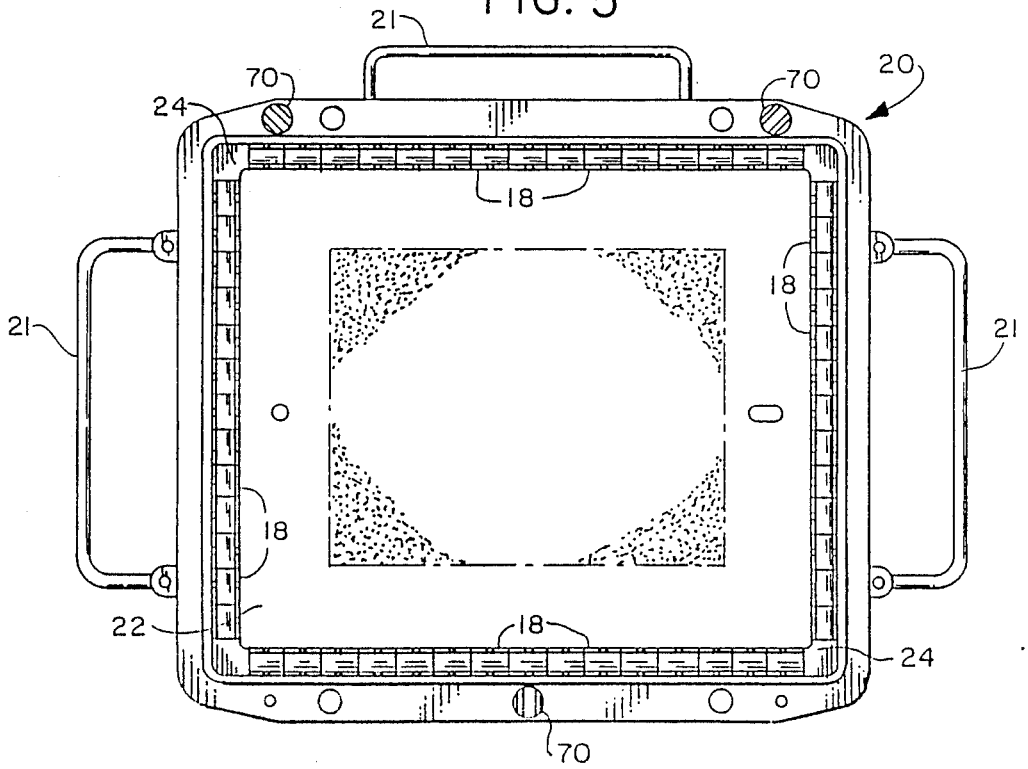
FIG. 6 is a plan view of the bottomside of a frame disclosing a plurality of spring clips clamping an in-process shadow mask in tension on the frame.

Briefly, the factory fixture frame according to the invention of the aforementioned copending application provides for the high precision in the registration of a foil in-process shadow mask with a flat faceplate during manufacture. The factory fixture frame is reusable and provides for the cementless and weldless foil tensioning and quick-retention of a in-process shadow mask during fabrication of the associated color cathode ray tube. As described in detail therein, the factory fixture frame has a first six-point indexing means 70 on one side for registration with complementary registration-affording means on an exposure lighthouse during manufacture of a color cathode ray tube (FIG. 6). A second six-point indexing means 71 is provided on a second, opposed, side of the factory fixture frame for registration with complementary registration-affording means on an in-process faceplate (FIG. 5). Therefore, the in-process shadow mask can be precisely registered and reregistered with the lighthouse and the in-process faceplate for the photoexposure of the faceplate while retaining the shadow mask in tension. The present invention is directed to a quick-release mechanical mask-retaining means for use on the reusable factory fixture frame to temporarilY and removably support the in-process shadow mask in tension.

Figure 1:
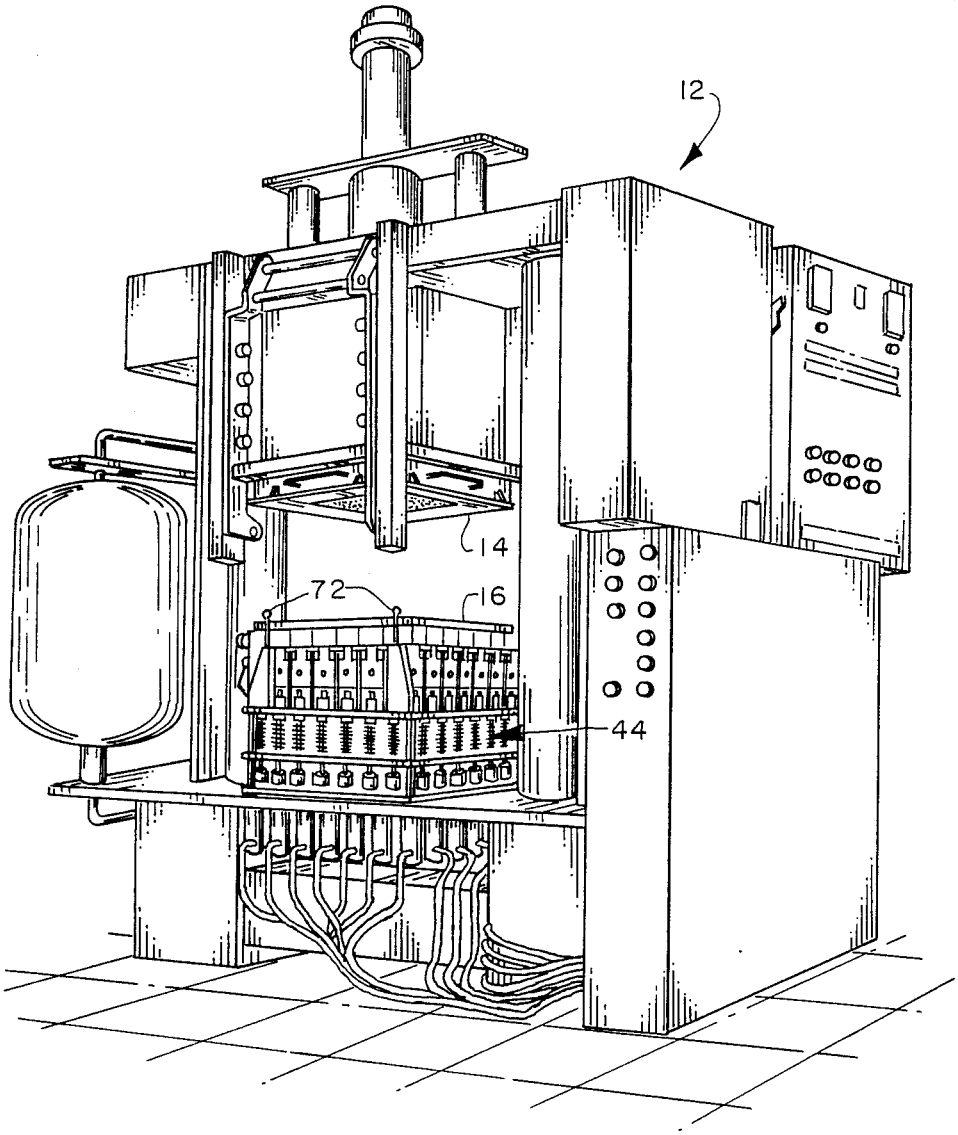
FIG. 1 is a view in elevation and in perspective of a mask tensing-clamping machine for receiving a factory fixture frame and mask retaining means according to the invention.

Referring generally to the drawings, FIG. 1 shows a mask tensing-clamping machine, generally designated 12, which provides for receiving a factory fixture frame which is loaded into the mask tensing-clamping machine by an operator. The machine has an upper heater platen 14 and a lower heater platen 16 which are energized to elevate the temperature of a heated shadow mask blank prior to the clamping operation.

Figure 2:
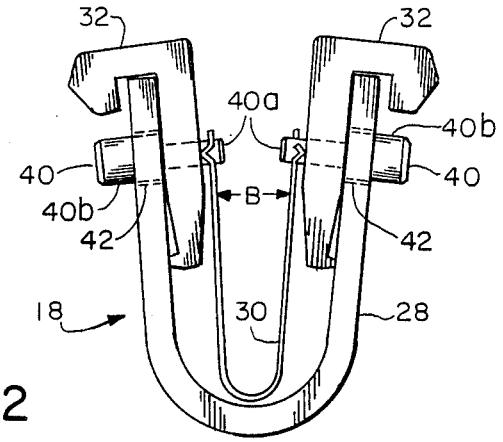
FIG. 2 is an end elevational view of one of the mask-clamping spring clips of the invention.
Figure 3:
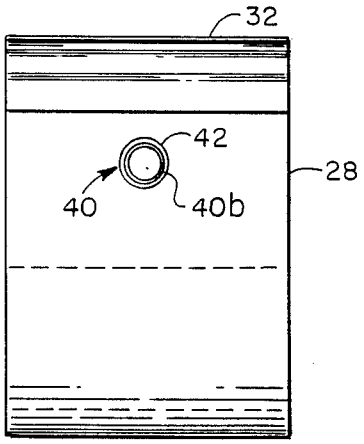
FIG. 3 is a side elevational view taken 90° to that of FIG. 2, of the spring clip.
Figure 4:
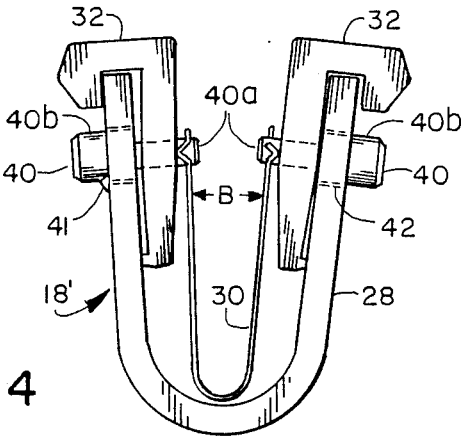
FIG. 4 is an end elevational view of a modified version of the FIG. 2 clip.

Again, in general, FIGS. 2–4 show the details of spring clips 18, 18' embodying the concepts of the invention.

FIGS. 5 and 6 show a factory fixture frame, generally designated 20, for precisely registering and reregistering a foil in-process shadow mask with a faceplate during manufacture. As is visible in FIG. 6, a plurality of spring clips 18 are employed in rows along each side of frame 20 for clamping the mask foil. Handles 21 are provided for enabling transport of the frame 20.

More particularly, referring again to FIGS. 5 and 6, factory fixture frame 20 provides for mounting an in-process shadow mask 22 during photoexposure of an in-process faceplate in a lighthouse, and serves as a fixture for the process of welding and trimming the in-process mask. The factory fixture frame is reusable and comprises a generally rectangular frame means and a quick-release mechanism comprising mask-retaining means (i.e. spring clips 18) for temporarily and removably supporting an in-process shadow mask 22 in tension by means of the spring clips 18. The factory fixture frame provides for a cementless and weldless quick-retention of an in-process shadow mask 22. Without going into great detail, suffice it to say that factory fixture frame 20 includes receptacle means in the form of grooves 24 (FIG. 6) for receiving an edge 26 of shadow mask 22, with spring clips 18 captivating the shadow mask in the grooves. In essence, the spring clips comprise a quick-release mechanical mask-retaining means for securing the shadow mask in tension in the receptacle means formed by grooves 24.

Mask tensing-clamping machine 12 (FIG. 1) receives a factory fixture frame 20 which is loaded into the machine by an operator. The machine also provides for receiving a shadow mask 22 in a free state between upper and lower platens 14 and 16, respectively. Generally, but as described in greater detail hereinafter, the platens are heated to elevate the temperature of shadow mask 22 as the platens sandwich the mask therebetween, which sandwiching serves principallY to flatten the mask and render it wrinkle-free. Edges 26 of the shadow mask are clamped into grooves 24 by spring clips 18 of the factory fixture frame while the shadow mask is heated. The edge-clamped shadow mask then is allowed to cool and shrink into tension while being temporarily and removably supported in this state, on frame 20 by spring clips 18. The frame, with its tensed shadow mask, then is ready to be transported through other processing steps, such as the aforesaid photoexposure of an in-process faceplate in a lighthouse.

Referring back to FIGS. 2 and 3, each spring clip 18 includes a relatively strong, generally U-shaped outer spring 28 and a generally U-shaped inner spring 30 of lesser strength. A pair of shoes 32 of inverted, generally L-shapes are positioned over the distal ends of U-shaped spring 28, as shown in FIGS. 2 and 4. Locating pins, generally designated 40, extend freely through concentrically disposed apertures in shoes 32 and the legs of spring 28, see FIG. 2 or 4. Specifically, each pin 40 has a reduced end **40*a* which extends through the respective shoe 32 and an enlarged end 40*b* which abuts the outwardly directed face of its assigned shoe and extends through aperture 42 in the adjacent leg of spring 28. The distal ends of U-shaped inner spring 30 are bifurcated and locate on ends 40*a* of pins 40 while, at the same time, apply a biasing force against the inside surfaces of shoes 32 in opposing directions, as indicated by arrows "B" (FIG. 2). The combination of the biasing spring 30, and the cooperative structure of shoes 32 combine to provide a "floating" or "lost-motion" action for shoes 32 to enable the shoes to yield and wipe the edge of the shadow mask as a spring clip 18 is inserted into groove 24** in the factory fixture frame, all in a manner to be described.

At this juncture it should be noted that spring clip 18' of FIG. 4 differs from clip 18 of FIGS. 2 and 3 only in that the pin 40 assigned to the leg of left shoe 32 (as viewed in FIG. 4) is welded, or otherwise fixed to the left leg of U-spring 28. This weld is identified by reference numeral 41. This effectively immobilizes the left shoe 32, for a purpose to be explained below.

Figure 7:
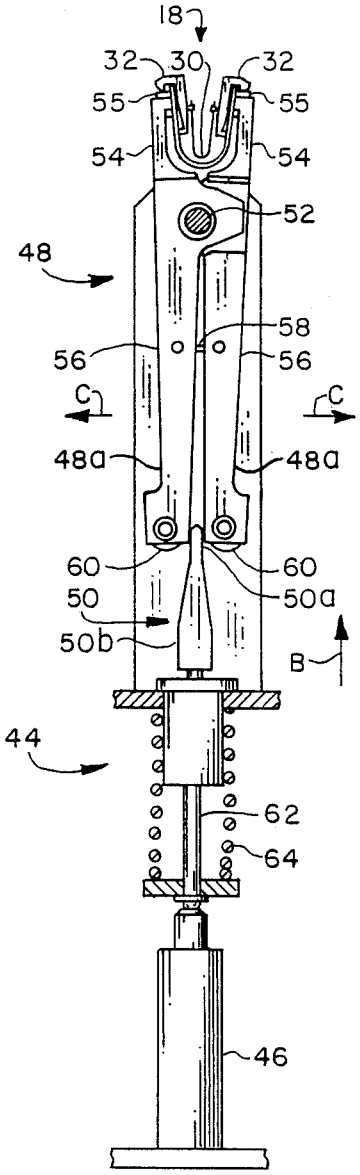
FIG. 7 is an end elevational view of an actuating mechanism employed in the machine of FIG. 1 for closing and opening the spring clips shown in FIGS. 2–4.
Figure 8:
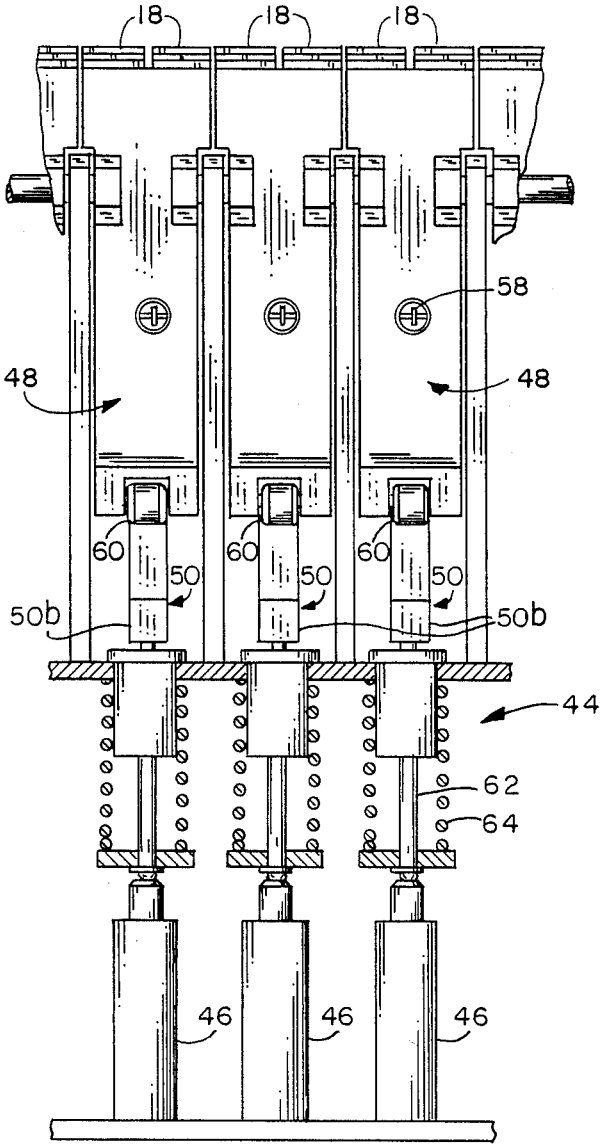
FIG. 8 is a side elevational view of a portion of the machine of FIG. 1, illustrating a partial bank of the mechanism shown in FIG. 7.

Referring to FIGS. 7 and 8 in conjunction with FIG. 1, machine 12 is seen to include rows of actuating mechanisms, generally designated 44, about the periphery of the four sides of lower heater platen 16. At least portions of these mechanisms are shown in FIGS. 7–14 and are provided to effect closing and opening of spring clips 18. As shown in FIGS. 7 and 8, one such actuating mechanism 44 is provided for closing and opening an adjacent pair of spring clips 18. The actuating mechanisms are operated by pneumatic piston and cylinder devices 46 which respond to the control center that governs the cyclic operation of machine 12.

Each actuating mechanism 44 includes a scissors-type spring clip closing device, or grippers, generally designated 48, a cam wedge 50, and a pneumatic piston and cylinder device 46. Scissors device 48 includes a pair of arms **48*a* pivoted intermediate their ends, as at 52, to define opposed jaws 54, at one end of the scissors device, and actuating arms 56 at the opposite end. A removable rub pad 55 is fastened atop each of jaws 54 to engage the underside of the associated shoe 32, see FIG. 9. This arrangement serves to prevent bight of U-Spring 28 from bottoming against jaws 54 and being removable they can be replaced when worn, rather than replace an entire scissor arm 48*a*. In addition, each gripper jaw 54 contains a pair of cavities 75 to generally locate each spring clip assembly 18 along the four rows of scissors assemblies 48. A tension spring 58 is disposed between actuating arms 56 to bias the arms inwardly and, thereby, jaws 54 to an open position. A pair of follower rollers 60 are journalled within the bottom of actuator arms 56 for engaging either of two dwell surfaces 50*a*, 50*b* on a cam wedge 50**, as described hereinafter.

Cam wedge 50 is coupled to a plunger or extension 62 of the piston portion of the piston and cylinder device 46. A biasing coil spring 64 surrounds plunger 62. From the foregoing, it can be seen that movement of cam wedge 50 by the pneumatic piston and cylinder device 46 in the direction of arrow "B" (FIG. 7) will cause the cam wedge to engage follower rollers 60 journalled on the lower ends of actuator arms 56. An upward displacement of cam wedge 50 from an initial position (FIG. 7), in which cam dwell surface **50*a* is in engagement with roller 60, to an elevated position (FIG. 9), in which dwell surface 50*b* engages roller 60, spreads actuator arms 48*a* outwardly in the direction of arrows "C" to cause a pivotal displacement of jaws 54 about point 52 inwardly in the direction of arrows "D". Since jaws 54 are in engagement with spring clip 18, an inward movement of the jaws is effective to drive the legs of U-shaped spring 28 inwardly to close the spring clip and effect inward movement of shoes 32 in the direction indicated by arrows "E", see FIG. 7**.

Figure 9:
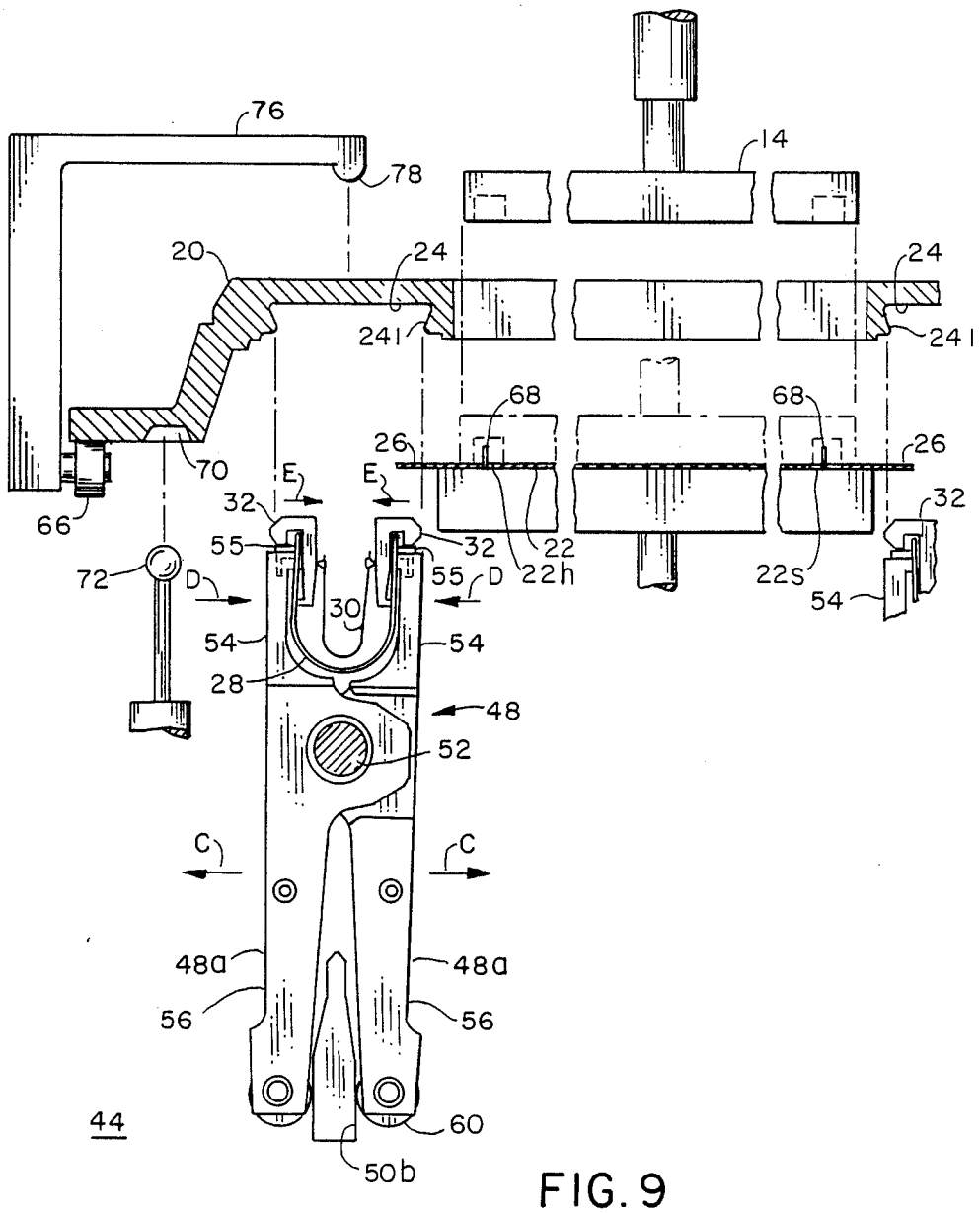
FIG. 9 is an elevational view of the upper portion of the mechanism illustrated in FIG. 7 in conjunction with a fragmented portion of a factorY fixture frame and a shadow mask disposed between two heater platens of the machine of FIG. 1.

The above described function of actuating mechanism 44 is depicted in FIG. 9 and this action, in conjunction with the mask clamping function of the upper and lower heater platens 14 and 16 of machine 12 serve to clamp the edges 26 of mask 22 in the receptacle grooves 24 of the factory fixture frame 20.

To particularize, FIG. 7 shows the aforesaid components in a condition wherein cam wedge 50 is lowered, gripper jaws 54 are open, as is spring clip 18 and actuating mechanism 44 is in its deenergized condition.

Turning now to FIG. 9,.a factory fixture frame 20 has been inserted in the central opening in the FIG. 1 machine 12 and is supported by loading rollers 66 (only one shown).

To initiate a mask heating, expansion, clamping, cooling and tensing process, a foil mask 22 is placed upon the lower heater platen 16 and indexed thereon by a pair of mask locating pins 68. One of these pins enters a hole **22*h* in the mask while the other pin is received in a mask slot 22*s*, see FIG. 9. Upper heater platen 14 is then dropped to sandwich mask 22 between it and platen 16** to "iron" it out. The sandwiched mask is then heated by the platens to induce mask expansion.

Figure 10:
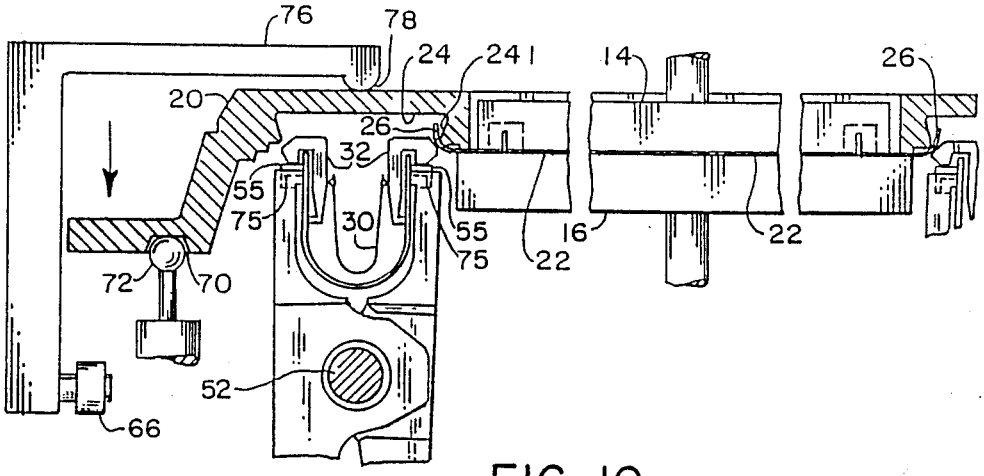
FIG. 10 is a view similar to that of FIG. 9 but with the spring cliP actuating mechanism, the factory fixture frame and the platens in position with the spring clip initiating control with the edge of the shadow mask.

The factory fixture frame 20 is then lowered making contact with the lower heater platen 16. As the lower platen 16 is pushed downward the upper platen follows. Referring now to FIG. 10, the sandwiched mask 22 is now wiped, with consistent uniformity, into grooves 24 of fixture 20 by shoes 32, which shoes are cammed inwardly by the inwardly directed lip 241 of fixture groove 24. This action serves to roll the mask intimately around lip **24*e* as shoe 32 slides relative to the mask against the resistance posed by drag spring 30. At the same time, the undersides of the shoe shoulders slide across rub pads 55**.

During the above-described procedure, i.e., as the frame 20 is lowered, each of three indexing slots 70 in its outer flange area engage one of three precision guidance spheres 72 which are pneumatically urged upwards. This arrangement assures an accurate alignment of frame 20 with respect to the mask array since the lateral relationship of the guidance spheres is fixed relative to the locating pins 68 on lower heater platen 16.

Note, at this stage, FIG. 10, that support of frame 20 has been transferred from rollers 60 to spheres 72 and that the frame transport 76 continues to exert downward pressure upon frame 20 to drive the frame against the bank of foil wrapping shoes 32. This is occasioned by engagement of the transport contacts 78 with frame 20 as they drive the frame down against the restraint offered by the pneumatically loaded guidance spheres 72 and the subsequently additional restraint offered by the pneumatically extended lower heater platen 16.

Figure 11:
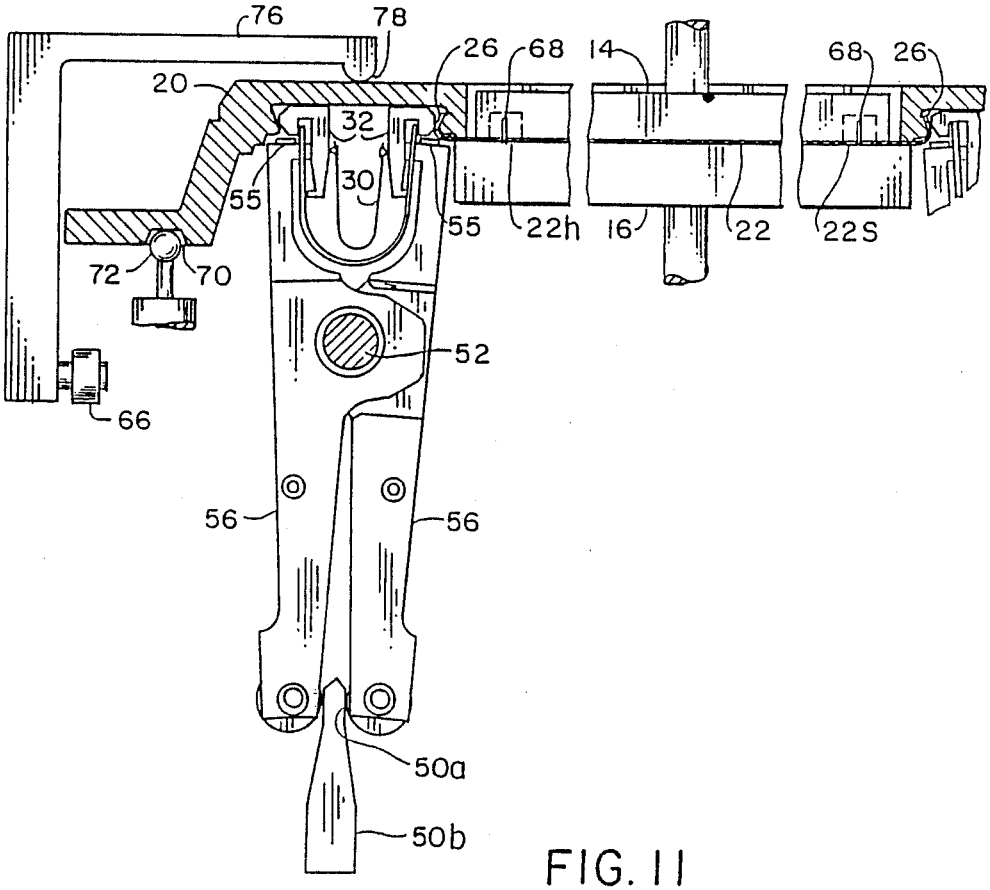
FIG. 11 is a view operationally sequential to the views of FIGS. 9 and 10, showing the spring clip fully inserted, to maintain the shadow mask in tension while supported by a factory fixture frame.

Referring to FIG. 11, downward travel of frame 20 is arrested by shoes 32 as they, upon full insertion into groove 24, sustain all frame transport loads through their reaction with the rub pads 55 on the scissors 48 which in turn are verticallY grounded to the machine bed through pivot rods 52.

In the next sequence, pneumatic cylinders 46 are deenergized permitting springs 64 to retract cam wedges 50. This causes gripper jaws 54 to open and therefore freeing U-shaped springs 28 such that upon subsequent raising of frame transporter 76, frame 20 together with its heat shrinking shadow mask 20 and clamp means 18 are free of all processing components of machine 12. This condition, shown in FIG. 12, permits removal of the factory fixture frame 20 and shadow mask 22 for further procedures in the cathode ray tube manufacturing process.

Figure 12:
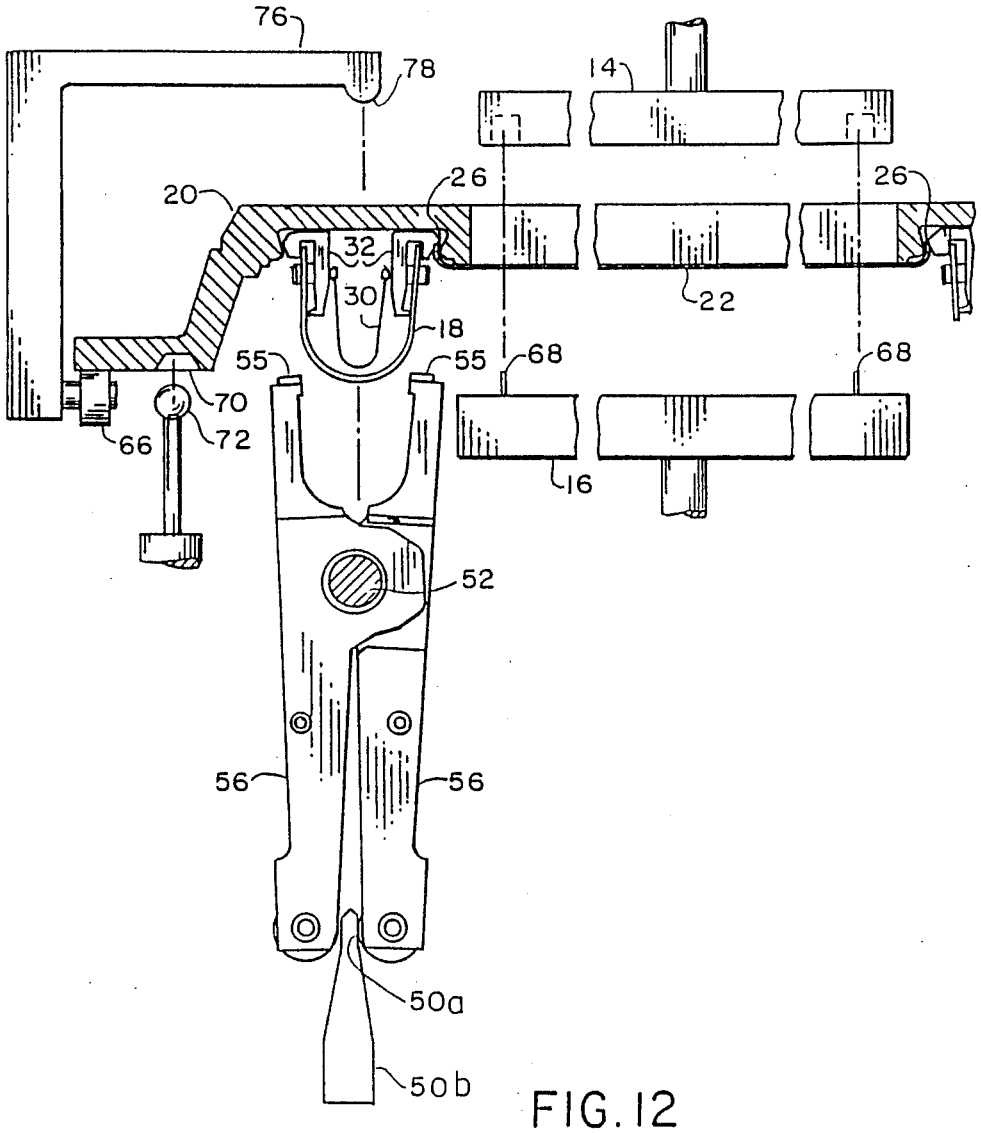
FIG. 12 is a fragmented and partially sectioned view, on an enlarged scale, illustrating withdrawal from a spring clip actuating mechanism and depicting the position of a spring clip shoe holding the shadow mask in tension on the factory fixture frame.
Figure 13:
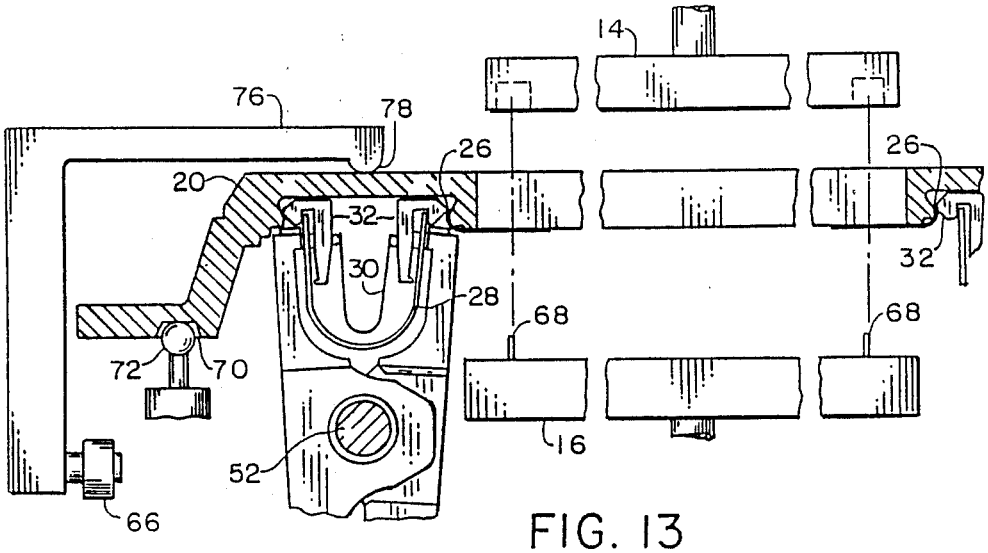
FIG. 13 is a fragmented and partially sectional view illustrating initiation of the mask scrap removal process.
Figure 14:
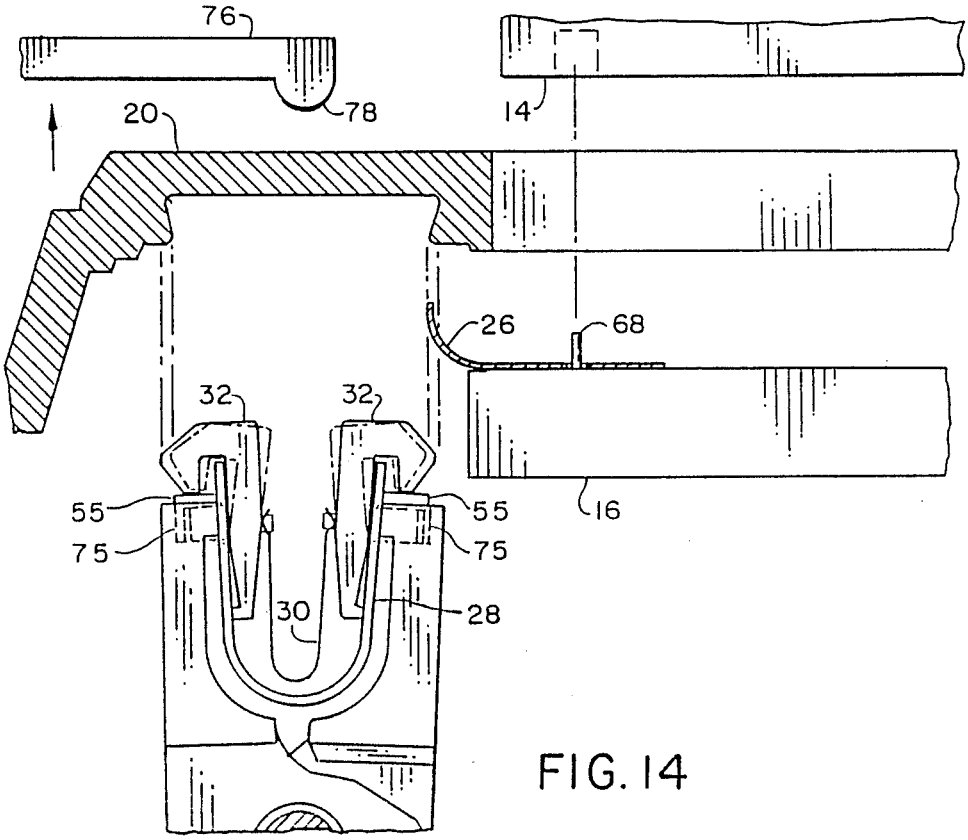
FIG. 14 is a fragmented and partially sectioned view depicting completion of the mask scrap removal process.

In the prior discussion, procedures have been described for the heating of a foil shadow mask and its subsequent wiping, installation, and anchoring to an in-process factory fixture frame. This semi-automatic process however is "closed loop". A frame which has undergone all other cathode ray tube front end manufacturing procedures returns to the mask tensing-clamping machine 12 containing the periphery of the shadow mask 22, the central array portion having been severed by a laser beam after being welded to a mask support structure attached to the CRT faceplate. This periphery is securely clamped to the factory fixture frame 20 by the spring clips 18. In order to attain a stage depicted in FIG. 9, the factory fixture frame with its scrap mask portion must be loaded into machine 12, the spring clips temporarily removed, and the mask scrap discarded. The machine configuration at the beginning of this process is best depicted by FIG. 12 except that the frame 20 and spring clips 18 which have just been loaded into machine 12 capture only a peripheral scrap portion 26 of shadow mask 22 as shown in FIGS. 13 and 14. Frame 20 is lowered by frame carriage 76 such that spring clips 18 freely enter open jaws 54 of the multiplicity of scissors device 48. The downward motion of the carriage 76 and frame 20 is arrested as described before. The system configuration at this stage is depicted in FIG. 13. Cylinders 46 are then energized thus elevating cam 50 to drive cam dwell **50*b* between rollers 60 to drive scissors arms 48*a* outward and scissors jaws 54 inward to compress U-spring 28. Thus, the shoes 32 are relieved of the high clamping contact with the side walls of groove 24. This contact is achieved through exertion of the heavy U-springs 28 when they are not being compressed by the gripper jaws 54. The mask scrap 26 is now no longer anchored to the factory fixture frame 20 and upon subsequent raising of the frame 20 by the carriage 76, the mask peripheral scrap 26 can be readily removed from machine 12. This condition is shown in FIG. 14. It should be noted that during this "extraction" process, the shoes 32 are cammed inwards relative to the U-springs 28 by the frame lips 241** in order that the nose of the shoes can clear the lips.

Accordingly, upon removal of the scrap remnant of mask 22 the apparatus 12 is now ready to receive the next mask foil 22 for the tensing-clamping procedure thus, effectively, ending and initiating the aforesaid closed loop process.

As previously noted in the FIG. 4 embodiment of spring clip 18, the left shoe is retracted inward against the left leg of U-spring 28 and immobilized in this position by welding pin 40 to the left leg of spring 28. This side of the spring clip assembly is always deployed. To the "outside", or non-mask wiping side of the basic spring clip orientation. This was determined in practice of the invention to be desirable for minimizing adverse frictional forces during automatic insertion of the spring clips into the factory fixture frames.

What is claimed is:

1. For use in the manufacture of a color cathode ray tube having a flat faceplate and a tensed foil shadow mask, a factory fixture frame for mounting an in-process shadow mask and having indexing means for repeatably registering said in-process mask with a respectively associated faceplate during front assembly manufacture, the frame including peripheral groove means for receiving an edge of the shadow mask, and quick-release mechanical mask-retaining means complementarily mating with said groove means for temporarily and removably supporting an in-process shadow mask in tension.

2. The factory fixture frame of claim 1 wherein the sides of said groove means are undercut, and said quick-released shaped for positioning in the undercut areas of the groove means.

3. For use in the manufacture of a color cathode ray tube having a flat faceplate and a tensed foil shadow mask, a factory fixture frame for mounting an in-process shadow mask having indexing means for repeatably registering said in-process mask with a respectively associated faceplate, said frame comprising generally rectangular frame means having quick-release mechanical mask-retaining means for temporarily and removably supporting in tension an in-process shadow mask.

4. For use in the manufacture of a color cathode ray tube having a flat faceplate and a tensed foil shadow mask, a factory fixture frame for mounting an in-process shadow mask, said frame having indexing means for repeatably registering said in-process mask with a respectively associated faceplate, said frame comprising generally rectangular frame means having quick-release mechanical mask-retaining means for temporarily and removably retaining a thermally expanded in-process shadow mask without slippage upon cool-down and without applying additional tension in the mask.

5. For use in the manufacture of a color cathode ray tube having a flat faceplate and a tensed foil shadow mask, a factory fixture frame for mounting an in-process shadow mask, said frame comprising generally rectangular frame means having quick-release mechanical mask-retaining means temporarily and removably supported in tension an in-process shadow mask, said mask-retaining means having means for permitting actuation and deactuation of said mask-retaining means by an automated instrumentality.

6. For use in the manufacture of a color cathode ray tube having a flat faceplate and a tensed foil shadow mask, a factory fixture frame for mounting an in-process shadow mask and being adapted for unique association with a particular faceplate during front assembly manufacture, said frame comprising frame means of sufficient strength to withstand tensile forces of a mask in tension, but light enough for manual transport and having handle means facilitating such transport, said frame including quick release mechanical mask-retaining means for temporarily and removably supporting an in-process shadow mask in tension.

7. For use in the manufacture of a color cathode ray tube having a flat faceplate and a tensed foil shadow mask, a factory fixture frame for mounting an in-process shadow mask and being adapted for respective association with a particular faceplate during front assembly manufacture, said frame having indexing means for repeatably registering said in-process mask with a respectively associated faceplate, said frame comprising frame means of sufficient strength to withstand tensile forces of a mask tension, but light enough for manual transport and having handle means facilitating such transport, same frame means having quick-release mechanical mask-retaining means for temporarily and removably retaining without slippage upon cool-down a thermally expanded in-process shadow mask.

8. For use in the manufacture of a color cathode ray tube having a flat faceplate and tensed foil shadow mask, a factory fixture frame for mounting an in-process shadow mask and being adapted for respective association with a particular faceplate during front assembly manufacture, said frame having indexing means for repeatably registering said in-process mask with a respectively associated faceplate, said frame comprising frame means of sufficient strength to withstand tensile forces of a mask in tension, but light enough for manual transport and containing handle means facilitating such transport, said frame means having quick-release mechanical mask-retaining means for temporarily and removably retaining a thermally expanded in-process shadow mask without slippage upon cool-down and without applying additional tension to the mask, said mask-retaining means having means permitting actuation and deactuation of said mask-retaining means by an automated instrumentality.

9. For use in the manufacture of a color cathode ray tube having a flat faceplate and a tensed foil shadow mask, a factory fixture frame for mounting an in-process shadow mask and having indexing means for repeatably registering said in-process mask with a respectively associated faceplate during front assembly manufacture, said frame comprising generally rectangular frame means having peripheral receptacle means substantially thereabout, and quick-release mechanical mask-retaining means complementarily mating with said receptacle means for temporarily and removably supporting an in-process shadow mask in tension.

10. The factory fixture frame of claim 9 wherein said receptacle means comprise groove means for receiving an edge of the shadow mask, with the quick-release mechanical mask-retaining means supporting the shadow mask in tension in the groove means.

11. The factory fixture frame of claim 10 wherein said quick-release mechanical mask-retaining means comprise spring-clip means matingly receivable in said groove means.

12. The factory fixture frame of claim 11 wherein said spring-clip means comprise a plurality of individual spring clips positionable in side-by-side relationship along the length of the groove means.

13. For use in the manufacture of a color cathode ray tube having a flat faceplate and a tensed foil shadow mask, a factory fixture frame for mounting an in-process shadow mask and having indexing means for repeatably registering said in-process mask with a respectively associated faceplate during front assembly manufacture, the frame including peripheral receptacle means substantially thereabout, and quick-release spring-clip means matingly receivable in said receptacle means for temporarily and removably retaining an in-process shadow mask in tension.

14. The factory fixture frame of claim 13 wherein said spring-clip means comprise a plurality of individual spring clips positionable in side-by-side relationship along the length of the receptacle means.

15. For use in the manufacture of a color cathode ray tube having a flat faceplate and a tensed foil shadow mask, a factory fixture frame for mounting an in-process shadow mask, said frame comprising generally rectangular frame means having peripheral groove means thereabout for receiving an edge of the shadow mask, and a plurality of individual spring clips positionable in side-by-side relationship along the length of the groove means for temporarily and removably supporting an in-process shadow mask in tension, each spring clip comprising a generally U-shaped spring having opposed shoe means on the distal ends of the legs of the U-shaped spring for engagement within the groove means.

16. For use in the manufacture of a color cathode ray tube having a flat faceplate and a tensed foil shadow mask, a factory fixture frame for mounting an in-process shadow mask, said frame comprising generally rectangular frame means having peripheral groove means thereabout for receiving and edge of the shadow mask, and a plurality of individual spring clips positionable in side-by-side relationship along the length of the groove means for temporarily and removably supporting an in-process shadow mask in tension, each spring clip comprising a generally U-shaped spring having opposed shoe means on the distal ends of the legs of the U-shaped spring for engagement within the groove means, the shoe means comprising an individual shoe member on the distal end of each leg of the U-shaped spring.

17. For use in the manufacture of a color cathode ray tube having a flat faceplate and a tensed foil shadow mask, a factory fixture frame for mounting an in-process shadow mask, said frame comprising generally rectangular frame means having peripheral groove means thereabout for receiving an edge of the shadow mask, the side of said groove means being undercut, and a plurality of individual spring clips positionable in side-by-side relationship along the length of the groove means for temporarily and removably supporting an in-process shadow mask in tension, each spring clip comprising a generally U-shaped spring having opposed shoe means on the distal ends of the legs of the U-shaped spring for engagement within the groove means, the shoe means comprising an individual shoe member on the distal end of each leg of the U-shaped spring and complementarily shaped for positioning in the undercut areas of the groove means.

18. For use in the manufacture of a color cathode ray tube having a flat faceplate and a tensed foil shadow mask, a factory fixture frame for mounting an in-process shadow mask, said frame comprising generally rectangular frame means having peripheral groove means thereabout for receiving an edge of the shadow mask, the sides of said groove means being undercut, and a plurality of individual spring clips positionable in side-by-side relationship along the length of the groove means for temporarily and removably supporting an in-process shadow mask in tension, each spring clip comprising a generally U-shaped spring having opposed shoe means on the distal ends of the legs of the U-shaped spring for engagement within the groove means, the shoe means comprising an individual shoe member on the distal end of each leg of the U-shaped spring and complementarily shaped for positioning in the undercut areas of the groove means, and the undercut areas of the groove means and the shoes having complementarily interengageable flat surfaces for sandwiching the tensed shadow mask therebetween.

19. For use in the manufacture of a color cathode ray tube having a fluid flat faceplate and a tensed foil shadow mask, a factory fixture frame for mounting an in-process shadow mask, said frame comprising generally rectangular frame means having peripheral groove means thereabout for receiving an edge of the shadow mask, and a plurality of individual spring clips positionable in side-by-side relationship along the length of the groove means for temporarily and removably supporting an in-process shadow mask in tension, each spring clip comprising a generally U-shaped spring having opposed shoe means on the distal ends of the legs of the U-shaped spring for engagement within the groove means, the shoe means comprising an individual shoe member on the distal end of each leg of the U-shaped spring, and each shoe being mounted on the spring by lost-motion means to provide for limited movement of the shoe relative to the spring.

20. For use in the manufacture of a color cathode ray tube having a flat faceplate and a tensed foil shadow mask, a factory fixture frame for mounting an in-process shadow mask, said frame comprising generally rectangular frame means having peripheral groove means thereabout for receiving an edge of the shadow mask, and a plurality of individual spring clips positionable in side-by-side relationship along the length of the groove means for temporarily and removably supporting an in-process shadow mask in tension, each spring clip comprising a generally U-shaped spring having opposed shoe means on the distal ends of the legs of the U-shaped spring for engagement within the groove means, the shoe means comprising an individual shoe member on the distal end of each leg of the U-shaped spring, each shoe being mounted on the spring by lost-motion means to provide for limited movement of the shoe relative to the spring, and secondary spring means operatively associated between the shoes and the U-shaped spring for biasing the shoes outwardly in opposite directions toward the sides of the groove means.

21. For use in the manufacture of a color cathode ray tube having a flat faceplate and a tensed foil shadow mask, a factory fixture frame for mounting an in-process shadow mask, said frame comprising generally rectangular frame means having peripheral groove means, the sides of the groove means being undercut, and a plurality of individual spring clips positionable in side-by-side relationship along the length of the groove means for temporarily and removably supporting an in-process shadow mask in tension, each spring clip comprising a generally U-shaped spring having opposed shoe means on the distal ends of the legs of the U-shaped spring for engagement within the groove means, the shoe means comprising an individual shoe member on the distal end of each leg of the U-shaped spring complementarily shaped for positioning in the undercut areas of the groove means, each shoe being mounted on the spring by lost-motion means to provide for limited movement of the shoe relative to the spring, and secondary spring means operatively associated between the shoes and the U-shaped spring for biasing the shoes outwardly in opposite directions toward the sides of the groove means.

22. For use in the manufacture of a color cathode ray tube having a flat faceplate and a tensed foil shadow mask, a factory fixture frame for mounting an in-process shadow mask, said frame comprising generally rectangular frame means having peripheral groove means, the sides of the groove means being undercut, and a plurality of individual spring clips positionable in side-by-side relationship along the length of the groove means for temporarily and removably supporting an in-process shadow mask in tension, each spring clip comprising a generally U-shaped spring having opposed shoe means on the distal ends of the legs of the U-shaped spring for engagement within the groove means, the shoe means comprising an individual shoe member on the distal end of each leg of the U-shaped spring complementarily shaped for positioning in the undercut areas of the groove means, the undercut areas of the groove means and the shoes having complementarily engageable flat surfaces for sandwiching the tensed shadow mask therebetween, each shoe being mounted on the spring by lost-motion means to provide for limited movement of the shoe relative to the spring, and secondary spring means operatively associated between the shoes and the U-shaped spring for biasing the shoes outwardly in opposite directions toward the sides of the groove means.

23. For use in the manufacture of a color cathode ray tube having a flat faceplate and a tensed foil shadow mask, a factory fixture frame for mounting an in-process shadow mask, the frame including peripheral undercut groove means substantially thereabout for receiving an edge of the shadow mask, and quick-release spring-clip means matingly receivable in said receptacle means for temporarily and removably retaining an in-process shadow mask in tension, said spring-clip means including free-floating shoes for positioning in the undercut areas of the groove means.

24. For use in the manufacture of a color cathode ray tube having a flat faceplate and a tensed foil shadow mask, a factory fixture frame for mounting an in-process shadow mask, the frame including peripheral undercut groove means substantially thereabout for receiving an edge of the shadow mask, and quick-release spring-clip means matingly receivable in said receptacle means for temporarily and removably retaining an in-process shadow mask in tension, said spring-clip means including free-floating shoes for positioning in the undercut areas of the groove means, the undercut areas of the groove means and the shoes having complementarily interengageable flat surfaces for sandwiching the tensed shadow mask therebetween.

25. A process for use in the manufacture of a color cathode ray tube having a flat faceplate and a tensed foil shadow mask, comprising:

providing a factory fixture frame with peripheral receptacle means for mounting an in-process shadow mask and having indexing means for repeatably registering said in-process mask with a respectively associated faceplate during front assembly manufacture; and temporarily and removably supporting an in-process shadow mask in tension on said frame by quick-release mechanical mask-retaining means mating with said receptacle means.

26. The process of claim 25 wherein said shadow mask is heated and allowed to expand prior to being temporarily and removably supported on said frame.

27. The process of claim 26 wherein said shadow mask is allowed to cool and shrink in tension while being temporarily and removably supported on said frame.

28. A process for use in the manufacture of a color cathode ray tube having a flat faceplate and a tensed foil shadow mask, comprising:

providing a factory fixture frame with peripheral groove means for mounting an in-process shadow mask;

positioning an edge portion of the shadow mask over at least a portion of the groove means;

providing spring-clip means matingly receivable in said peripheral groove means for temporarily and removably supporting an in-process shadow mask in tension on said frame; and contracting said spring-clip means and moving the spring-clip means into said groove means.

29. A process for use in the manufacture of a color cathode ray tube having a flat faceplate and a tensed foil shadow mask, comprising:

providing a factory fixture frame with peripheral groove means for mounting an in-process shadow mask;

positioning an edge portion of the shadow mask over at least a portion of the groove means;

providing spring-clip means matingly receivable in said peripheral groove means for temporarily and removably supporting an in-process shadow mask in tension on said frame;

contracting said spring-clip means and moving the spring-clip means into said groove means; and allowing said spring-clip means to expand to effect said temporary and removable support of the in-process shadow mask on said frame.

30. A process for use in the manufacture of a color cathode ray tube having a flat faceplate and a tensed foil shadow mask, comprising:

providing a factory fixture frame with peripheral groove means for mounting an in-process shadow mask;

positioning an edge portion of the shadow mask over at least a portion of the groove means;

heating said shadow mask and allowing the shadow mask to expand;

providing spring-clip means matingly receivable in said peripheral groove means for temporarily and removably supporting an in-process shadow mask in tension on said frame;

contracting said spring-clip means and moving the spring-clip means into said groove means; and allowing said spring-clip means to expand to effect said temporary and removable support of the in-process shadow mask on said frame.

31. A process for use in the manufacture of a color cathode ray tube having a flat faceplate and a tensed foil shadow mask, comprising:

providing a factory fixture frame with peripheral groove means for mounting an in-process shadow mask;

positioning an edge portion of the shadow mask over at least a portion of the groove means;

heating said shadow mask and allowing the shadow mask to expand;

providing spring-clip means matingly receivable in said peripheral groove means for temporarily and removably supporting an in-process shadow mask in tension on said frame;

contracting said spring-clip means and moving the spring-clip means into said groove means;

allowing said spring-clip means to expand to effect said temporary and removable support of the in-process shadow mask on said frame; and allowing said shadow mask to cool and shrink in tension while being temporarily and removably supported on said frame.

32. A process for use in the manufacture of a color cathode ray tube having a flat faceplate and a tensed foil shadow mask, comprising:

providing a factory fixture frame with peripheral groove means for mounting an in-process shadow mask;

positioning an edge portion of the shadow mask over at least a portion of the groove means;

providing spring-clip means matingly receivable in said peripheral groove means for temporarily and removably supporting an in-process shadow mask in tension on said frame; and contracting said spring-clip means and moving the spring-clip means into said groove means in a wiping action against said edge portion of the shadow mask.

33. A process for use in the manufacture of a color cathode ray tube having a flat faceplate and a tensed foil shadow mask, comprising:

providing a factory fixture frame with peripheral receptacle means for mounting an in-process shadow mask; and temporarily and removably supporting an in-process shadow mask in tension on said frame by spring clip means matingly receivable in peripheral groove means on said frame.

34. A process for use in the manufacture of a color cathode ray tube having a flat faceplate and a tensed foil shadow mask, comprising:

providing a factory fixture frame with peripheral receptacle means for mounting an in-process shadow mask;

positioning an edge portion of the shadow mask over at least a portion of peripheral groove means on said frame; and temporarily and removably supporting an in-process shadow mask in tension on said frame by spring clip means matingly receivable in said peripheral groove means on said frame.

* * * * *